US005248206A

United States Patent [19]

Kawanabe

[11] Patent Number: 5,248,206

[45] Date of Patent: Sep. 28, 1993

[54] PRINTER CARRIAGE POSITIONING APPARATUS FOR CHARACTER DELETION

[75] Inventor: Tetsuya Kawanabe, Yokohama, Japan

[73] Assignee: Canon Kabushiki Kaisha, Tokyo, Japan

[21] Appl. No.: 716,764

[22] Filed: Jun. 19, 1991

Related U.S. Application Data

[63] Continuation of Ser. No. 360,142, Jun. 1, 1989, abandoned.

[30] Foreign Application Priority Data

Jun. 3, 1988 [JP] Japan ..... 63-136786

[51] Int. Cl.[5] ..... B41J 5/30

[52] U.S. Cl. ..... 400/63; 395/146; 400/279

[58] Field of Search ..... 400/63, 74, 695-697.1, 400/279, 320, 322; 364/419; 395/146

[56] References Cited

U.S. PATENT DOCUMENTS 4,561,793 12/1985 Blanchard ..... 400/697.1
4,834,566 5/1989 Mori et al. ..... 400/697
4,834,567 5/1989 Ueno ..... 400/697.1
4,955,734 9/1990 Nakazawa ..... 400/63

FOREIGN PATENT DOCUMENTS 0228292 7/1987 European Pat. Off. ..... 400/63
0256633 2/1988 European Pat. Off. ..... 400/63
2156559 10/1985 United Kingdom ..... 400/63

*Primary Examiner*—Edgar S. Burr
*Assistant Examiner*—Steven S. Kelley
*Attorney, Agent, or Firm*—Fitzpatrick, Cella, Harper & Scinto

[57] ABSTRACT

A character processing apparatus such as an electronic typewriter which can erase the recorded characters on a word unit basis. The apparatus includes: a keyboard to input a plurality of character strings such as English words; a memory to store the character strings input by the keyboard; a printer head which can record the character strings stored in the memory onto a recording paper and can delete the recorded character strings; a deletion instructing device to instruct to delete one of the character strings recorded on the paper by the printer head; and a control which is constructed in a manner such that in response to the deletion instruction, when the printer head exists at the position corresponding to the character string recorded on the paper, this character string is deleted, and when the printer head does not exist at the position corresponding to the character string recorded on the paper, the printer head is moved to the position of the nearest character string and this character string is deleted. The printer head is a head of the type wheel printer mechanism. With the apparatus, in the word deleting mode, the running cost can be reduced, the throughput can be improved, and the word deletion can be easily executed by a simple operation.

11 Claims, 14 Drawing Sheets

RIX : REVERSE INDEX
SP : SPACE
BTR : BACK TRACE
DEL : DELETE
WDEL : WORD DELETE

PRINTER CARRIAGE POSITIONING APPARATUS FOR CHARACTER DELETION

This application is a continuation of application Ser. No. 360,142 filed Jun. 1, 1989, now abandoned.

BACKGROUND OF THE INVENTION

1. Field of the Invention

The present invention relates to a character processing apparatus and, more particularly, to an electronic typewriter in which recorded characters or the like can be deleted on a word unit basis.

2. Related Background Art

A conventional electronic typewriter has a printing apparatus and a keyboard input apparatus. The keyboard input apparatus has various kinds of function keys such as character input keys, a space key and a back space key to feed a printer head to the right and left in the horizontal direction, a return key, an index key, and a reverse index key to feed a recording paper upward and downward in the vertical direction, and a delete key to delete recorded characters or the like when they were erroneously input or the like, etc.

On the other hand, in recent years, the electronic typewriter has been electronized more and more. There has been provided an electronic typewriter having a back trace function in which, by storing recorded characters or the like into memory means such a memory or the like, a printer head is returned to a plurality of preceding lines of the recorded characters or the like on a character or word unit basis. Further, there has been provided an electronic typewriter having a word delete function in which characters or the like recorded in the same line are deleted on a word unit basis.

In such an electronic typewriter, the operator makes a desired document or the like by operating the keyboard.

For instance, to make a sentence as shown in FIG. 13A, the key input operations are executed in accordance with an order as shown in FIG. 13B.

In FIG. 13B, SP denotes a space key and RTN indicates a return key. By inputting the return key, a recording paper is fed by a predetermined amount and the printer head is moved to the position of y in FIG. 13A.

It is now assumed that the operator becomes aware of a mistake of the input of the words shown by a region x in the diagram and tries to correct "TYPEWRTER." to "TYPEWRITER.".

The first method of correction is shown in FIG. 14A. First, the printer head is moved from y to y' in FIG. 13A by returning the recording paper by a predetermined amount by performing the reverse index key input (RIX). Next, by executing the space key printer head is moved from y' to z in FIG. 13 By executing the delete key input (DEL) four times, the recorded characters are deleted in accordance with the order of ".", "R", "E", and "T". The character key input is then executed in accordance with the order of "I", "T", "E", "R", and "." so as to obtain the correct word spelling. In this manner, the correction is executed.

The second method is shown in FIG. 14B and is applied to an apparatus having the back trace function mentioned above. First, the printer head is moved from y to z in FIG. 13A by performing the back trace key input (BTR). The recorded characters ".", "R", "E", and "T" are deleted by executing the delete key input (DEL) four times in a manner similar to the above. Then, characters "I", "T", "E", "R", and "." are retyped. In this manner, the correction operation is executed.

The third method is shown in FIG. 14C and is applied to the case of an apparatus having the word delete function mentioned above. In a manner similar to the above, the printer head is moved to z in FIG. 13A by performing the back trace key input (BTR). "TYPEWRTER." are all deleted by executing the word delete key input (WDEL) and "TYPEWRITER." are retyped. In this manner, the correction is executed.

However, when comparing the number of key input times which are required to correct the sentence shown in the example, there is a drawback such that in the case of the first method, its value becomes a maximum and the operations are complicated. According to the second method using the back trace function as an improvement of the first method, although the operation to move the printer head to the deletion start position z is simplified, the number of key input operations which are required to delete a portion of a word is the same as that in the first method. In addition, as in the example, in order to change "TYPEWRTER." to "TYPEWRITER.", the operator must count the position where he wants to input "I", so that there is the drawback that an erroneous operation such that too many or the wrong recorded characters can be deleted.

The third method using the word delete function has been considered as an improvement on such methods. However, although the operability with respect to the deletion of the recorded characters is improved, all of the words are deleted by a single operation. Therefore, in the example, the portion of "TYPEWR" in "TYPEWRTER." is additionally deleted, so that "TYPEWR" must be again input and there is a drawback that the number of key input operations which are required for correction is larger than that in the second method.

On the other hand, according to the third method, since the number of deleting operations of the recorded characters is large, the operating time which is required for deletion, the amount of deleting ribbon used, the amount of a recording ribbon used when retyping, and the like increase. Thus, there are drawbacks such that the correcting time (throughput) increases and the running cost also increases.

In addition, even in any of the conventional methods mentioned above, in spite of the fact that the operator wants to correct the words which have just previously been recorded, he needs to execute other operations of the reverse index key (RIX), the space key (SP), the back track key (BTR), and the like which are not directly concerned with the deleting operation. Consequently, there is a drawback such that the correcting operation cannot be easily understood.

SUMMARY OF THE INVENTION

The present invention is made in consideration of the foregoing conventional example and it is an object of the invention to provide a character processing apparatus in which the reduction in running cost and the improvement in throughput in the word deleting operation can be realized and the operability regarding the word deletion is improved.

DETAILED DESCRIPTION OF THE PREFERRED EMBODIMENTS

An embodiment of the present invention will be described in detail hereinbelow with reference to the drawings.

First embodiment

Figure 1:
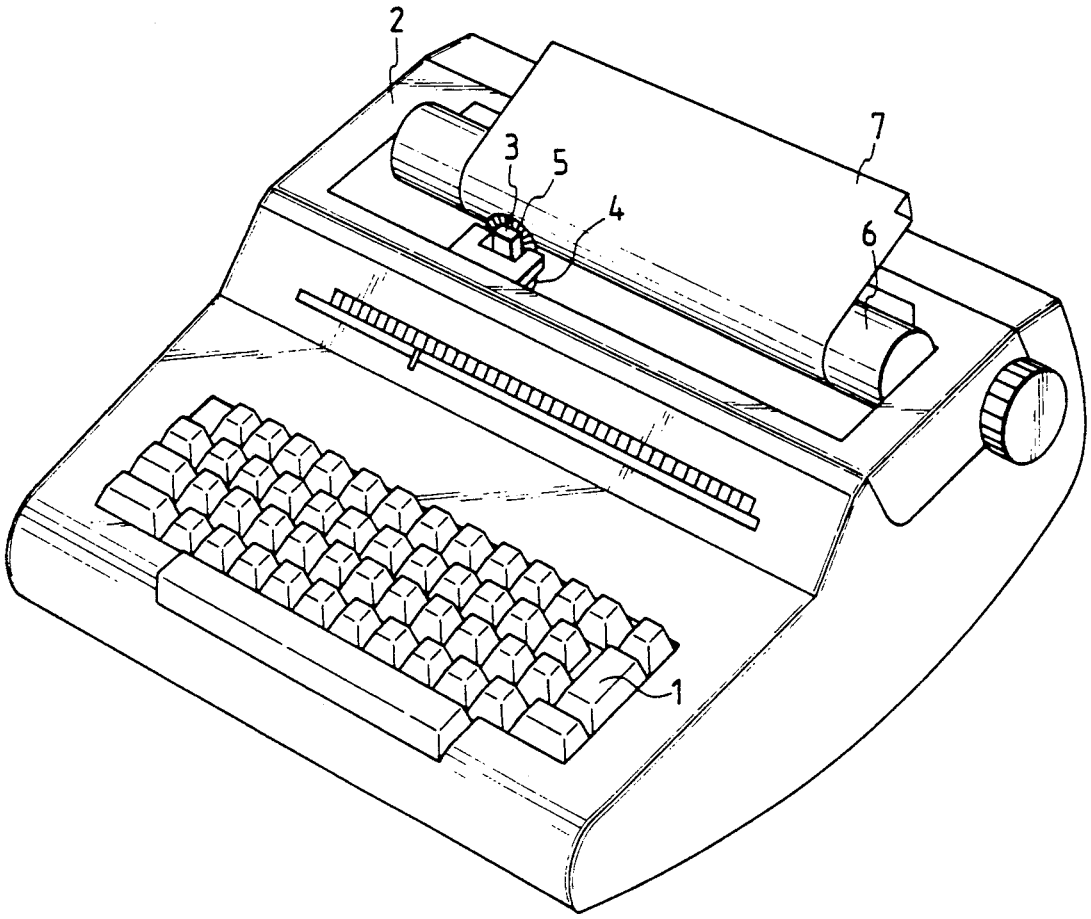
FIG. 1 is an external view of a typewriter according to an embodiment.

FIG. 1 is an external view of an electronic typewriter as a character processing apparatus to which the invention can be applied. In the diagram, reference numeral 1 denotes a keyboard on which character input keys and various kinds of function keys are arranged. Print data and various kinds of instruction data are input by the keyboard 1.

Reference numeral 2 denotes what is called a daisy wheel printer mechanism. A carriage 4 on which a printer head 3 is mounted can be moved in the longitudinal direction of a platen by a carrier motor (not shown) The carriage 4 has a wheel motor (not shown) which can select a desired type by rotating a type wheel 5 and a feed motor (not shown) to take up a print ribbon and a correction ribbon by predetermined amounts. The printer head 3 has a hammer (not shown) to print onto a paper through an ink ribbon by hitting the back surface of a desired type. When deleting a desired printed character, the carriage 4 is moved to the position of the printed character and, thereafter, the type of the type wheel 5 corresponding to the printed character to be deleted is selected by the wheel motor. The correction tape is set to the height of the type surface and the back surface of the type is hit. Thus, the printed character is peeled off or the white ink is coated onto the printed character, thereby deleting the character. Reference numeral 6 denotes a platen around which is a paper 7 is wound and which is rotated by a paper feed motor (not shown) or the like and feeds the paper. The platen 6 also functions as a recording base to receive the shock of the type by the hammer.

The printer mechanism 2 in the embodiment is operated by a control circuit, which will be explained hereinlater.

The control circuit of the above apparatus will now be described.

Figure 2:
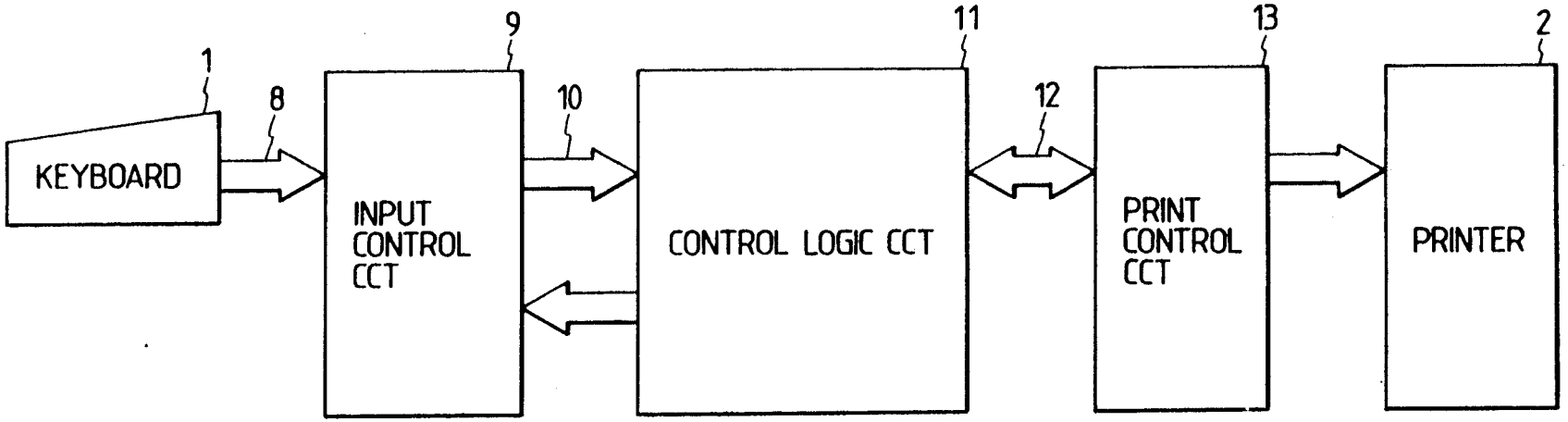
FIG. 2 is a control block diagram of the typewriter of the embodiment.
Figure 3:
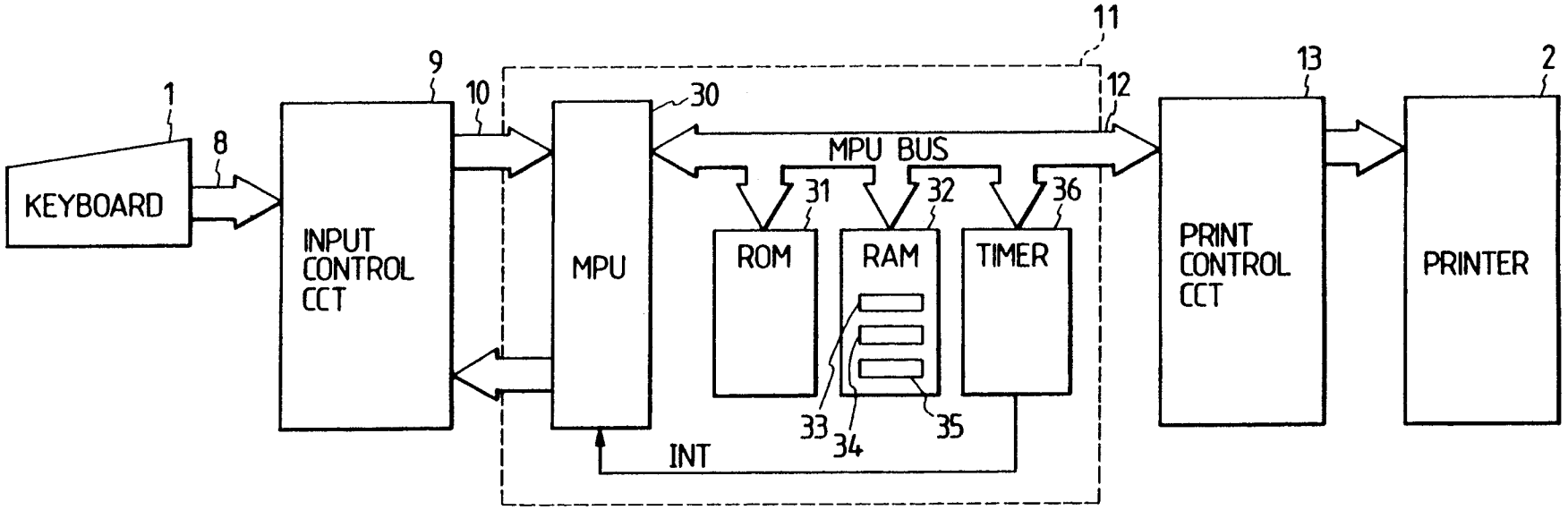
FIG. 3 is a diagram for explaining a control logic circuit.

FIG. 2 is a control block diagram and FIG. 3 shows a detailed construction of a control logic circuit 11 in FIG. 2.

The control logic circuit 11 comprises an MPU (microprocessing unit) 30, an ROM (read only memory) 31, an RAM (random access memory) 32, a timer 36, and the like. These components are connected by an MPU bus.

Figure 8:
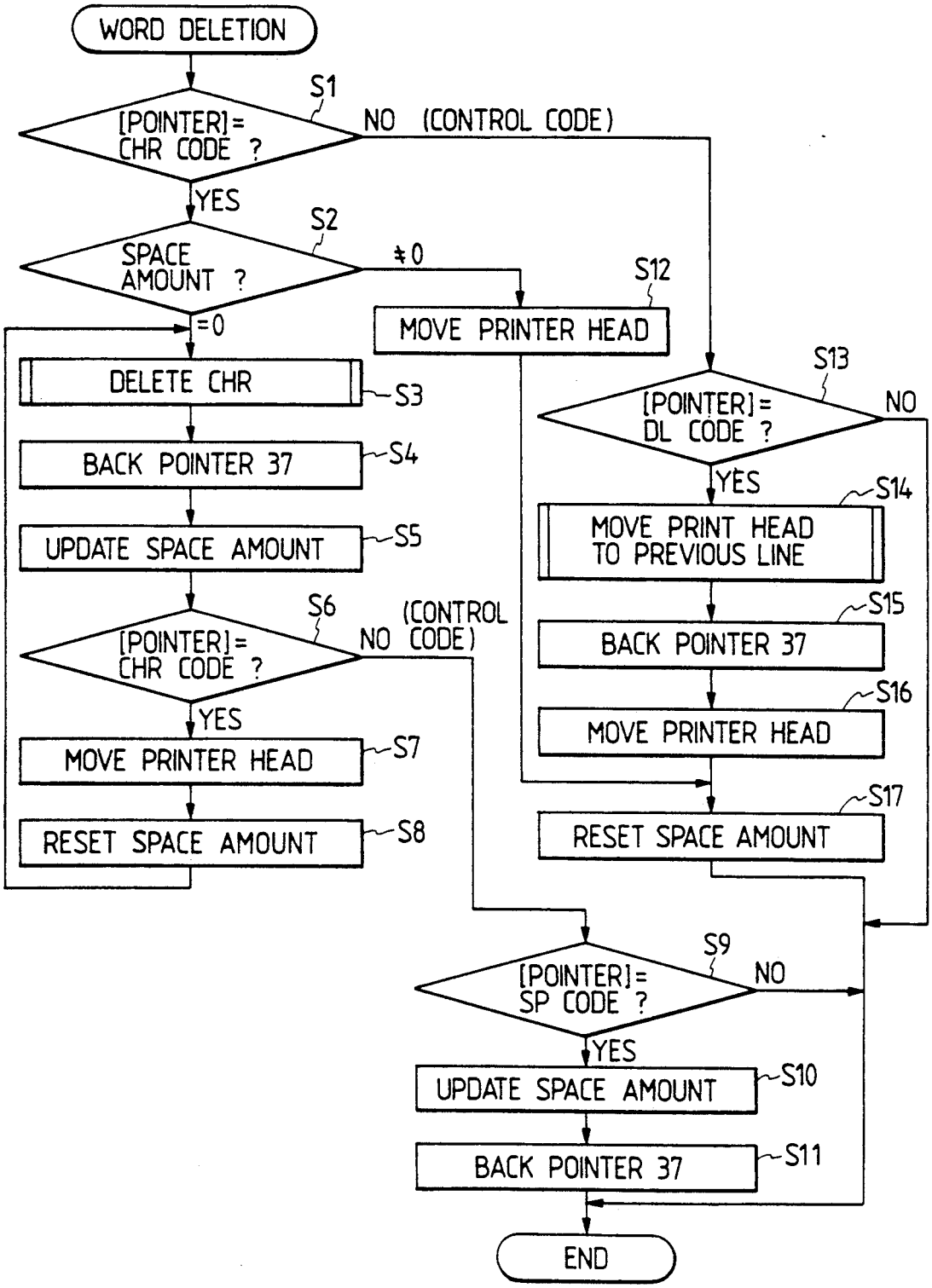
FIG. 8 is a flowchart for the word deleting process of a first embodiment.
Figure 11:
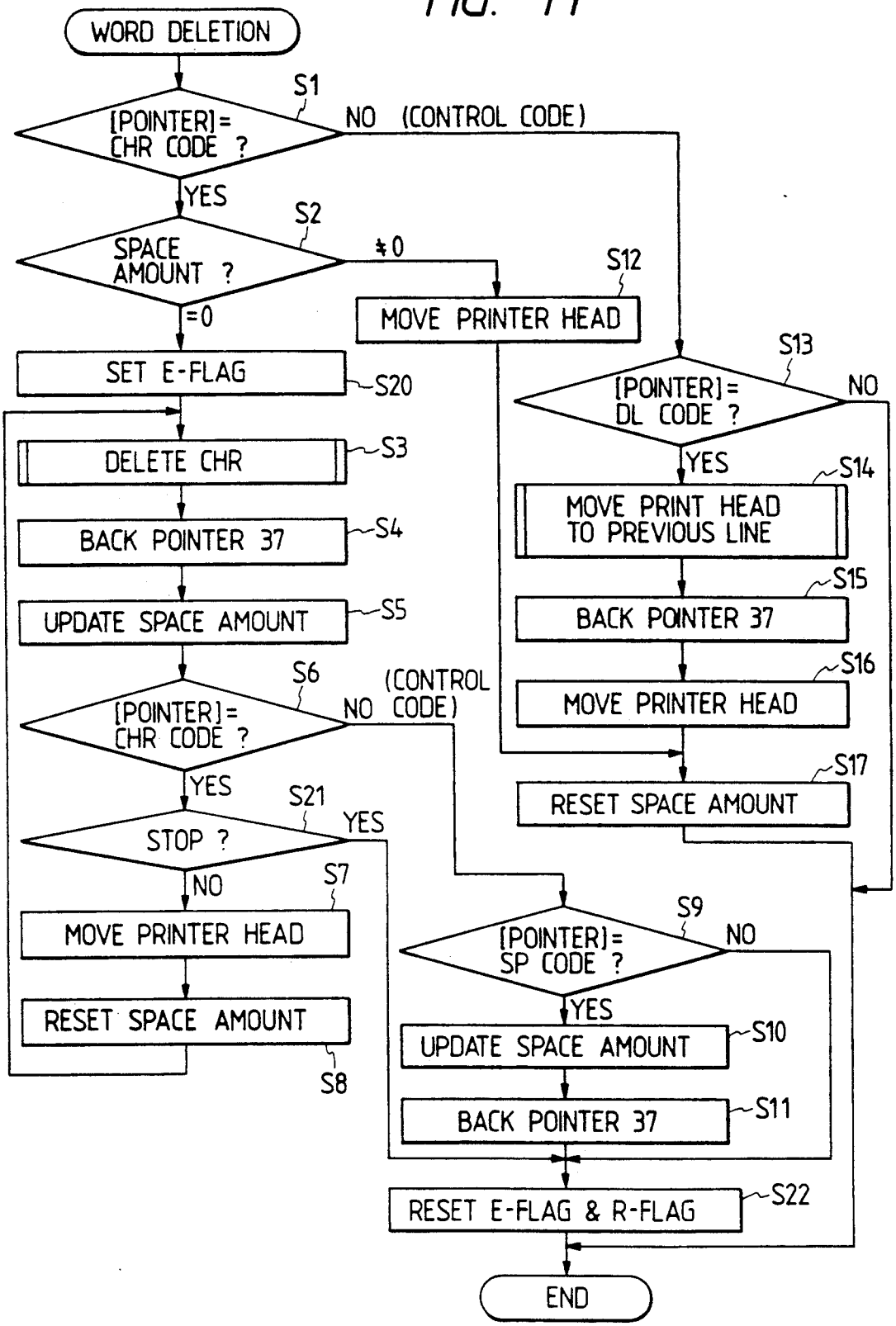
FIG. 11 is a flowchart for the word deleting process of the second embodiment.
Figure 12:
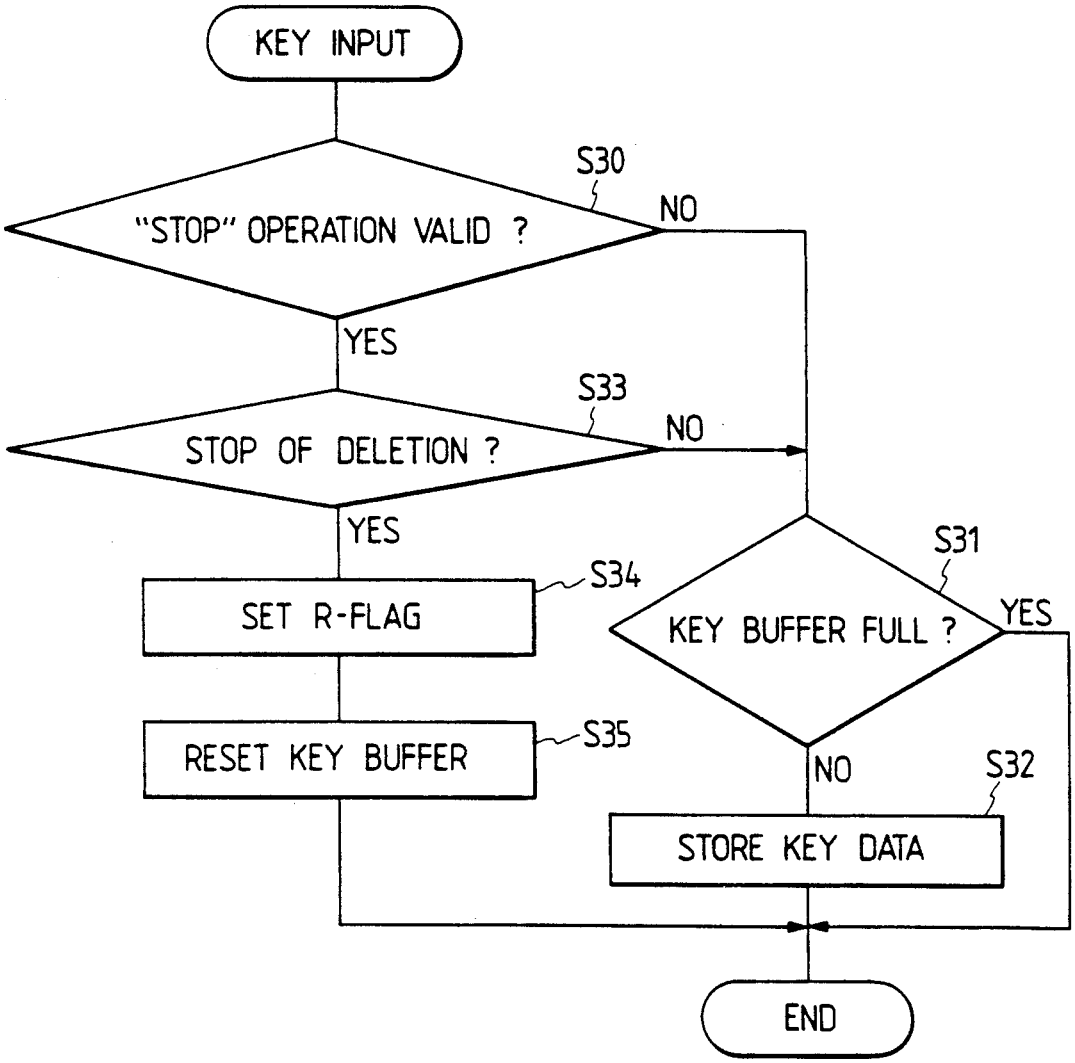
FIG. 12 is a flowchart for the key input process in the second embodiment.

With the above circuit construction, the MPU 30 executes the arithmetic operation control in accordance with micro instructions which have previously been stored in the ROM 31, receives the key input information from an input control circuit 9, and executes the input/output control with a print control circuit 13. Under the control of the MPU 30, the timer 36 generates reference time information, measures the elapsed time, generates an interruption request (INT) according to the time control condition, or controls the control logic circuit 11 in a real-time manner. Each of control flowcharts, which will be explained hereinlater, for instance, programs shown in FIGS. 8, 11, and 12 are stored in the ROM 31. The RAM 32 has work areas such as area for a key buffer 34 to temporarily store the key information input from the keyboard 1, area for a correction buffer 33 to store the characters or the like which were displayed and/or recorded, area for a buffer 35 of a pointer 37, a space amount 38, an E-flag, and R-flag, and a register which are necessary for the program control, and the like.

Contact devices which are interlocked with the keys which are operated by the operator are arranged on the keyboard 1 in a matrix form. The input control circuit 9 retrieves the input state of the keyboard 1 every predetermined period (5 msec) through a keyboard control line 8 by using the timer 36 and the like. When a key input is detected, the position on the matrix where the input key exists is examined and is converted into the microcode or the like. The key input data is supplied to the MPU 30 through an input interface 10. The MPU 30 analyzes the key input data and stores into the key buffer 34 in the RAM 32.

Since such an operation is executed by interrupting means or the like, it is certainly performed even during the execution of the print control, which will be explained hereinlater. Even if the key input is executed at a high speed, no key input data will be lost. On the other hand, the key buffer 34 has what is called a ring buffer structure and has the FIFO function.

When the key input data is stored in the key buffer 34, the MPU 30 sequentially reads out the key input data and discriminates whether the input key is the character key or one of the various kinds of function keys. If the input key indicates the printing operation or the like, the MPU 30 controls the operation of actuators such as carrier motor, wheel motor, and the like mentioned above through the print control circuit 13 comprising a motor driver and the like and makes the printer mechanism 2 operative, thereby executing the print control such as printing of a desired character, deletion of the character, or the like. To enable the characters to be automatically deleted by executing the delete key input or word delete key input, the printed characters and the like are stored into the correction buffer 33.

Figure 4:
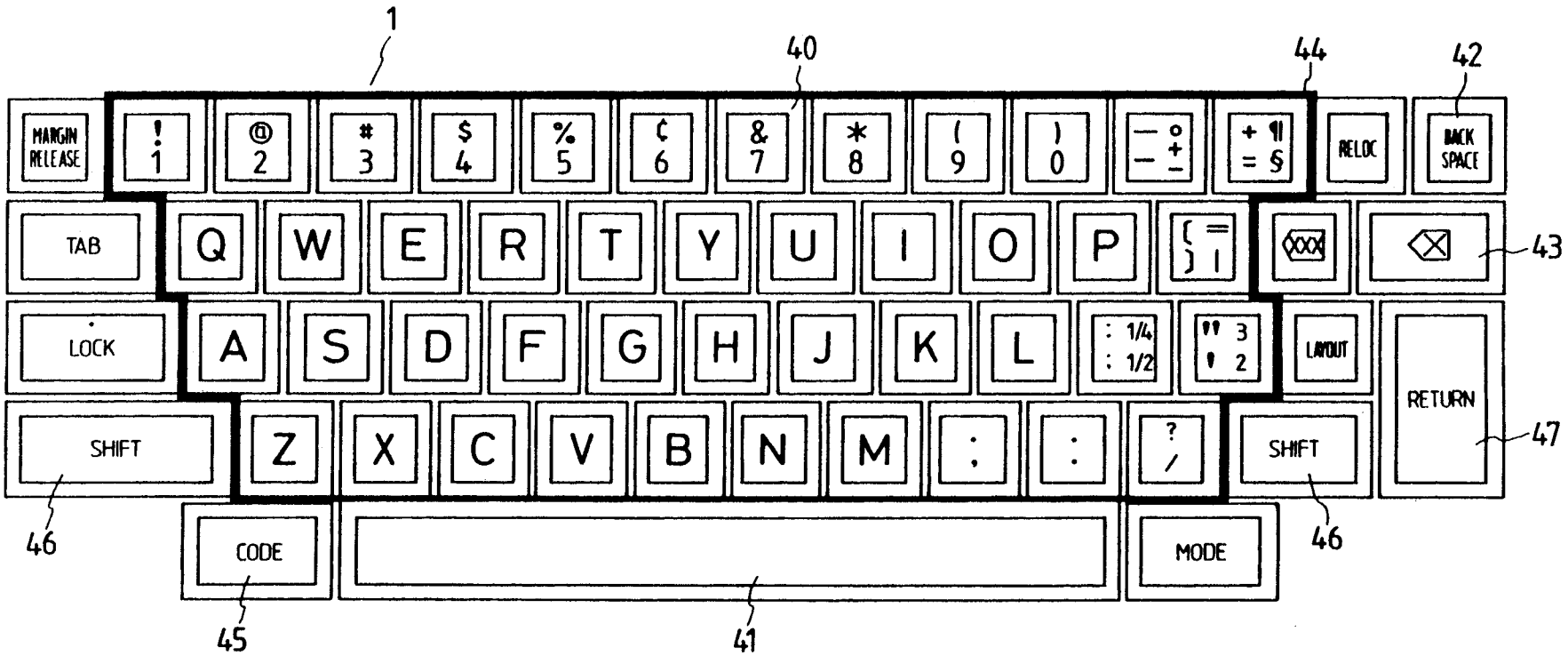
FIG. 4 is a diagram for explaining a keyboard of the typewriter of the embodiment.

The keyboard 1 will now be described with reference to FIG. 4.

The keyboard 1 comprises character keys 40 and various kinds of function keys and the like. By pressing the character key 40, the character written on the upper surface of the key depressed can be input and printed.

Reference numeral 41 denotes a space key to input a blank between words or to instruct to shift the carriage 4 to the right; 42 indicates a back space key to instruct the carriage 4 shift to the left; 43 denotes a delete key to instruct to erase the nearest printed character; 44 denotes a word delete key to indicate to delete the nearest printed characters on a word unit basis; and 45 denotes a code key to instruct to extend the function. By inputting another function key or character key with the code key 45 depressed, the depressed function key or character key functions as a sole function key. Therefore, many functions can be added without increasing the number of keys to the typewriter keyboard. Reference numeral 47 denotes a return key to instruct the carriage return and 46 indicates a shift key to instruct the switching between the capital letter and the small letter and between the numeral and the symbol. On the other hand, the shift key 46 can further instruct many functions in association with the code key 45.

The printed character storage control will now be described with reference to FIGS. 5A to 5C.

The printed character storage control is executed by using memory means such as correction buffer 33, buffer 35, and the like in the RAM 32. The buffer 35 has memory areas for the pointer 37 and space amount 38.

Figure 5A:
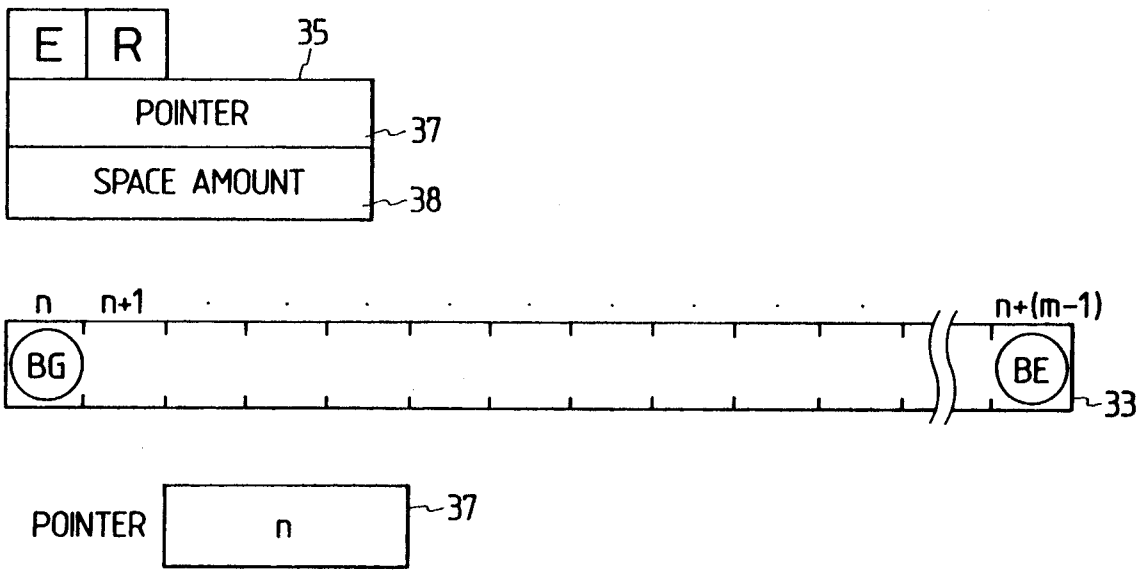
FIGS. 5A, 5B, 5C, 6A, 6B, 7A, and 7B are diagrams for explaining print character memory means.

FIG. 5A is a diagram for explaining the states of the correction buffer 33 and pointer 37 upon initialization by the power-on of the apparatus or the like. In the diagram, n indicates a head address in the correction buffer 33 in the RAM 32 and m represents an area size in the correction buffer 33. First, a buffer start code (BG) indicative of the head in the correction buffer 33 is stored into address n. A buffer end code (BE) indicative of the end in the correction buffer 33 is stored into address n+(m−1), that is, the end address in the correction buffer 33. Then, n is set into the pointer 37 to make the data from address n+1 to address n+(m−2) invalid. In the embodiment, the data from the address indicated by the pointer 37 to the buffer end code (BE) is handled as invalid data.

Figure 5B:
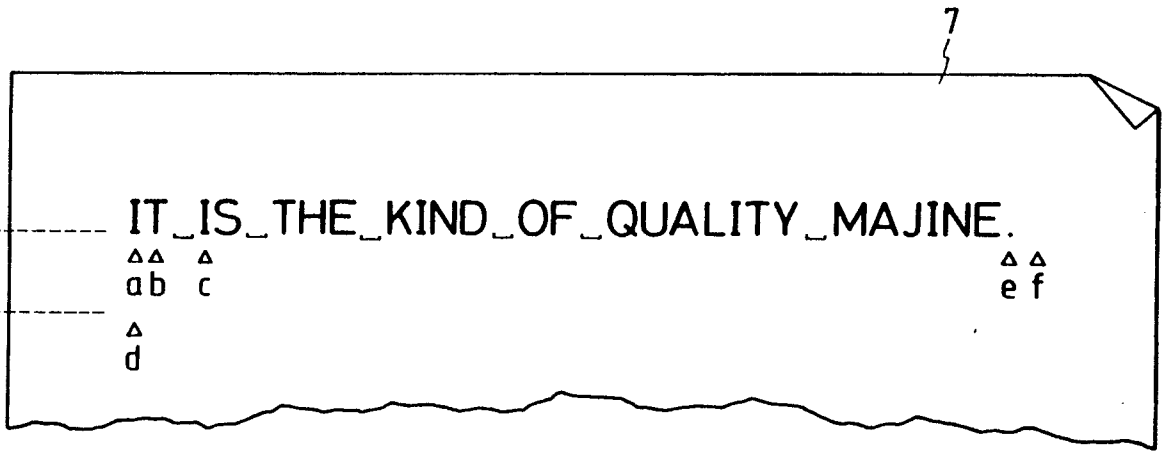

FIG. 5B shows the result in which "I", "T", "space key", . . . were sequentially input by the keyboard 1 of the apparatus and printed and output. FIG. 5C shows the states of the correction buffer 33 and pointer 37 at that time. The character printing and the storage of the printed characters will now be described.

First, the correction buffer 33 and pointer 37 are set into the foregoing states. The space amount 38 is set to "0". The printer head 3 is located at a in FIG. 5B. When "I" is input by the keyboard 1, the printer mechanism 2 is made operative and "I" is printed at the position a in FIG. 5B on the recording paper 7. Then, the printer head 3 is shifted by a predetermined amount and is located at the position b in FIG. 5B. At this time, the pointer 37 is advanced by (+1). The character code "I" is stored in address n+1 in the correction buffer 33. A feed amount of the printer head 3 is stored into the space amount 38. When "T" is then input, in a manner similar to the above, "T" is printed, the printer head is fed, the pointer 37 is advanced to n+2, the character code "T" is stored into address n+2 in the correction buffer 33, and the feed amount of the printer head 3 is set into the space amount 38. When "space" is then input, the printer head 3 is shifted by a predetermined amount and this amount is added to the space amount 38 and the new amount is stored. When "I" is subsequently input, "I" is printed at the position c in the diagram and the printer head is moved. Since the space amount 38 is larger than the feed amount by one digit, the pointer 37 is advanced to n+3. The space amount code (SP) is stored into address n+3. At this time, the space amount indicates the distance from "T" to "I". The pointer 37 is advanced to n+4. The character code "I" is stored into address n+4. The feed amount of the printer head 3 after "I" was printed is set into the space amount 38. A control similar to the above is executed in accordance with the order of "S", "space", "T", "H", "E", "space", "K", . . . When the "return key" is input, the carriage return is executed and the printer head 3 is moved to the position d in the diagram. At this time, the pointer 37 is advanced to n+33. In order to obtain the printing position (e in the diagram) of "." (period) stored in address n+32 as an absolute position of the printer head 3, the space amount 38 is subtracted from the absolute position information of the printer head 3. The resultant value is stored as a position code (CP) into address n+33. The pointer 37 is advanced to n+34. The line end code is stored into address n+34. The space amount is set to "0".

Figure 5C:
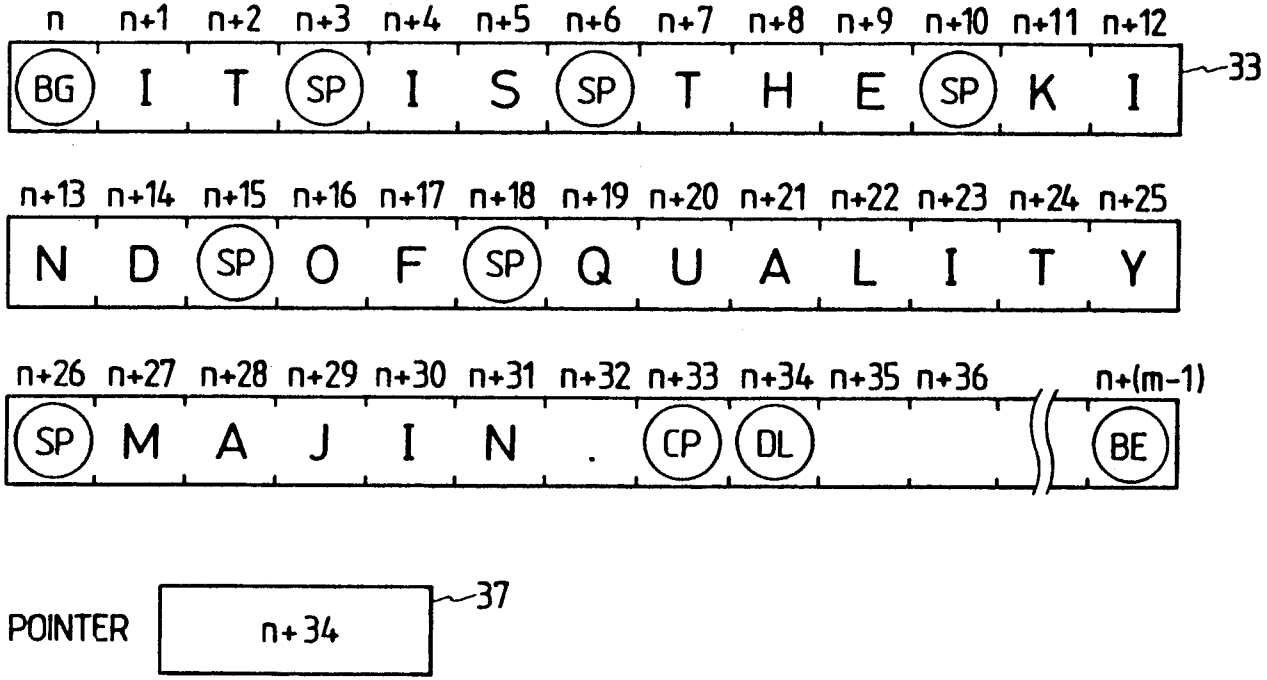

As mentioned above, in the embodiment, the printed characters are stored, thereby making the result of the printing shown in FIG. 5B correspond to the correction buffer 33 shown in FIG. 5C.

The word delete control will now be described.

When the word delete key 44 is input by the keyboard 1 of the apparatus in the state described in FIG. 5C, that is, under the control state in which the printer head 3 exists at the position d in FIG. 58, the pointer 37 indicates address n+34 in the correction buffer 33, and the line end code (DL) is stored in address n+34, the content in address n+34 in the correction buffer 33 which is indicated by the pointer 37 is first examined, thereby checking that the input data indicates the line end code (DL) instead of the character code. Since the input data is the line end code (DL) in this case, the recording paper 7 is returned in the vertical direction by a predetermined amount and the printer head 3 is set to the vertical position of the first line. The pointer 37 is moved back by (−1) and the content in address n+33 in the correction buffer 33 is examined. Since it indicates the position code (CP), the printer head 3 is moved to the absolute position indicated by the data of the position code. The space amount 38 is set to "0". The pointer 37 is moved back to indicate address n+32. By the above operation, the printer head 3 is moved to the position e corresponding to "." (period) shown in FIG. 6A. On the other hand, the correction buffer 33 and pointer 37 in such a state are as shown in FIG. 6B. Due to this, in the invention, when the word delete key 44 is input, if the printer head 3 does not exist at the position over the printed character, the printer head 3 is located to the nearest printed character. Therefore, even after the line feed was executed by the return key 47 or the like, the printer head 3 can be easily located to the final printed character or the end of the word. On the other hand, since the printer head 3 is ordinarily located at the position next to the final printed character, an inconvenience such that when the word delete key 44 is erroneously input, the word which does not need to be deleted, is deleted is prevented.

Figure 6A:
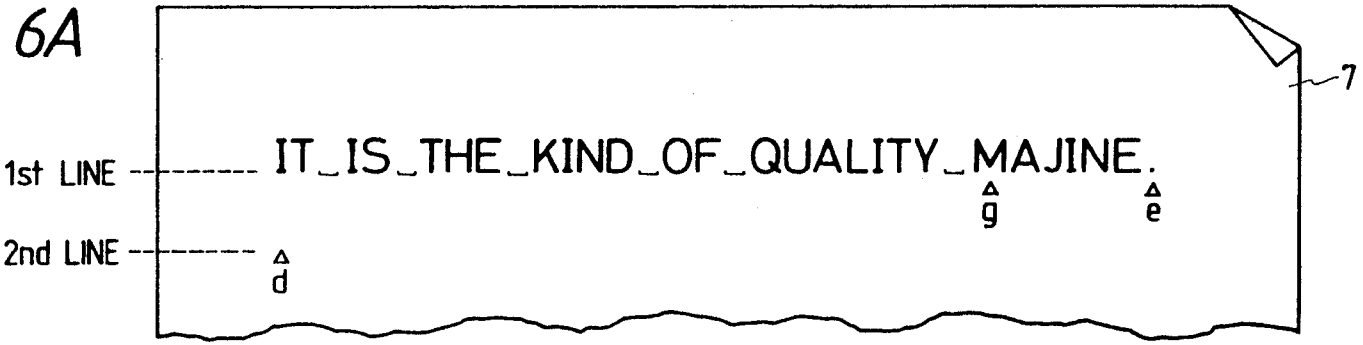
Figure 6B:
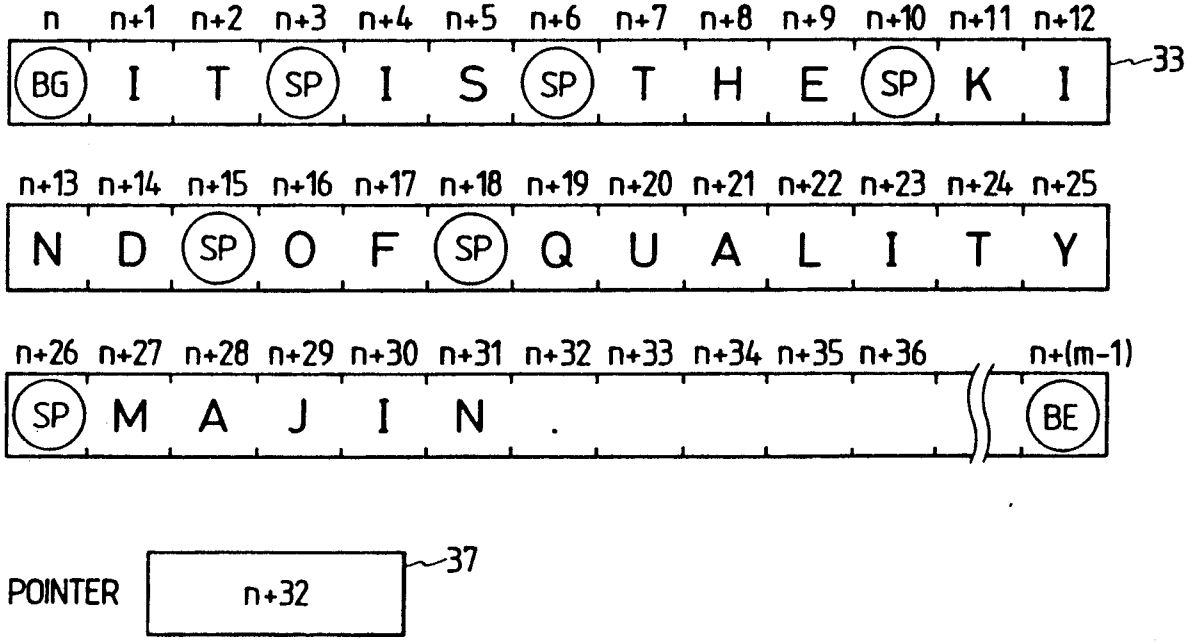

When the word delete key 44 is input in the above-mentioned state, that is, the state in which the printer head 3 exists at the position e in FIG. 6A, the pointer 37 indicates address n+32, the content of the correction buffer 33 is as shown in FIG. 6B, and the space amount 38 is set to "0", the pointer 37 indicates address n+32 and the character code "." (period) is set in address n+32 in the correction buffer 33. Therefore, the word deleting operation is executed. In other words, to delete "." (period), the type "." (period) of the type wheel 5 is selected and hit through the correction tape. The printed character "." (period) on the recording paper 7 is peeled off or the white ink is coated onto the printed character, thereby deleting the printed character.

Figure 7A:
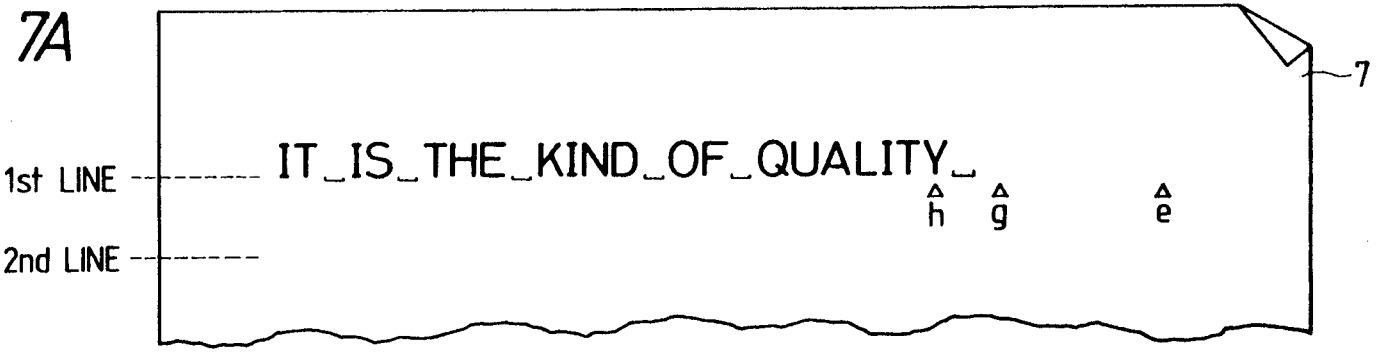
Figure 7B:
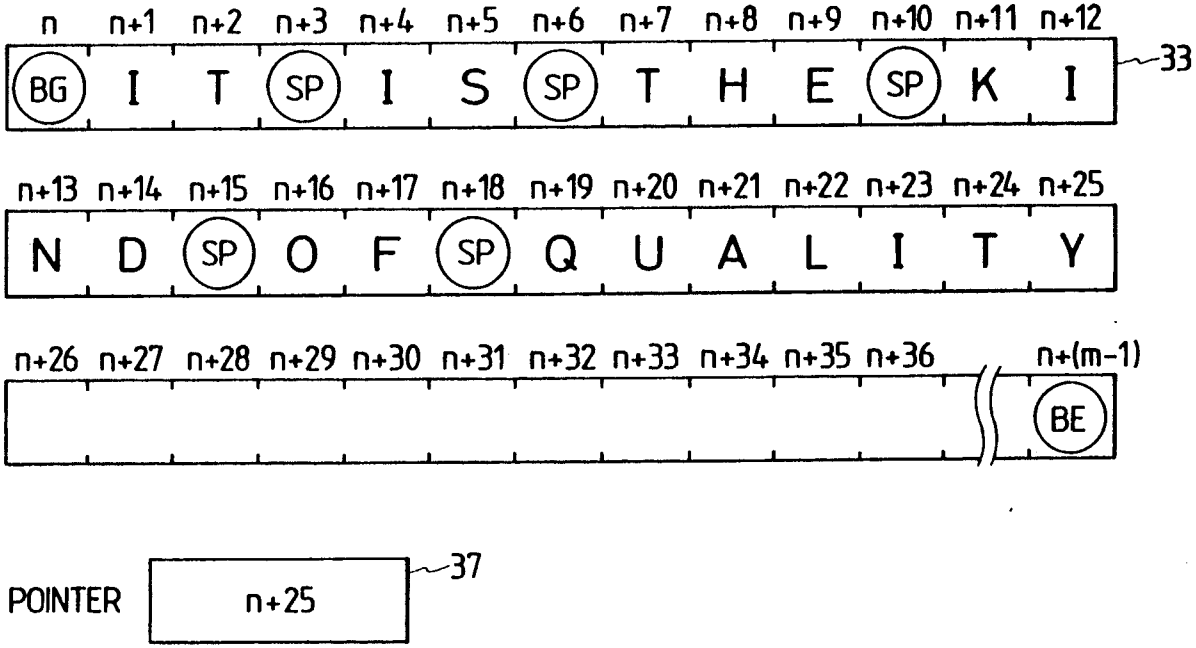

The pointer 37 is moved back by (−) and address n+31 is indicated. The distance from the present printer head position (e in the diagram) to "N" stored in address n+31 is stored into the space amount 38. Since address n+31 in the correction buffer 33 indicated by the pointer 37 represents the character code "N", the printer head 3 is moved to the position over the printed character "N" on the basis of the movement distance information of the space amount 38. Then, the space amount 38 is set to "0". In a manner similar to the above, "N" is deleted, the pointer 37 is moved back by (−1) to indicate address n+30, and the distance from the printer head position to "I" in address n+30 is stored into the space amount. When "J", "A", and "M" are deleted in a manner similar to the above, the pointer 37 indicates address n+26 in the correction buffer 33. The content in address n+26 indicates the space code (SP) instead of the character code. Thus, the word deletion is finished and a predetermined feed amount indicated by the space code (SP) is added to the space amount 38 and the resultant data is stored. After completion of the above operations, the recording paper 7 has a form as shown in FIG. 7A. The contents of the correction buffer 33 and pointer 37 are as shown in FIG. 7B. The printer head 3 is located at g in FIG. 7A. The distance from the present printer head position to the printed character "Y" is stored in the space amount 38.

When the word delete key 44 is again input, the pointer 37 indicates address n+25 in the correction buffer 33. The content in address n+25 is the character code "Y". However, the space amount 38 is not set to "0" and indicates that the printer head 3 does not exist over the printed character. Therefore, the word deletion is not executed. The printer head 3 is moved to the position (h in the diagram) over the printed character "Y" on the basis of the movement distance information of the space amount 38. The space amount 38 is set to "0" and the operation is finished. Consequently, according to the invention, even when the printer head 3 is located on the same line as the printed character, if the printer head 3 is not located over the printed character, the head 3 is moved to the nearest printed character.

That is, even in any case, if the printer head 3 is not located over the printed character when the word delete key 44 is input, the printer head 3 can be located to the position over the nearest printed character. Therefore, even in such a case, the word can be deleted by inputting the word delete key 44 twice. Thus, the word deletion can be executed without performing the complicated operations as in the conventional example.

The word deleting process which is executed by inputting the word delete key 44 mentioned above will now be described.

FIG. 8 is a flowchart for the word deletion processing program stored in the ROM 31 in the control logic circuit 11. This program is started by inputting a word delete instruction by the word delete key 44.

In the first step S1, a check is made to see if the content in a predetermined address in the correction buffer 33 indicated by the pointer 37 is the character code or not. If YES, step S2 follows and a check is made to see if the space amount 38 is set to "0" or not to thereby discriminate whether the printer head 3 exists over the printed character or not. If the head 3 is located over the printed character (space amount 38="0"), step S3 follows and the word deletion is started. In step S3, the printer mechanism 2 is activated and the printed character on the recording paper 7 is deleted on the basis of the printed character data stored in predetermined addresses in the correction buffer 33 indicated by the pointer 37. In step S4, the pointer 37 is moved back to delete the data of the erased printed character from the correction buffer 33. In step S5, the distance from the position of the printer head 3 to the stored character or the like indicated by the pointer 37 is obtained and stored into the space amount 38.

In the next step S6, if the stored data indicated by the pointer 37 is the character code, step S7 follows and the printer head 3 is moved back by only the distance stored in the space amount 38 in order to move the printer head 3 to the position over the printed character of the stored data indicated by the pointer 37. In step S8, the space amount 38 is reset to "0". The processing routine is again returned to step S3 and a desired character is deleted. The processes in steps S3 to S8 are repeated until the control code is detected in step S6. When the control code is detected in step S6, step S9 follows. If the pointer does not indicate the space code (SP), this means that the buffer start code (BG) or line end code (DL) has been detected. Therefore, the word deleting process is finished. On the other hand, if the pointer indicates the space code (SP), step S10 follows and the shift amount is added to the space amount 38 and the resultant value is stored. The space code (SP) is deleted in step S11 and the word deleting process is finished.

On the other hand, if the space amount 38 is not "0" in step S2, this means that the printer head 3 does not exist over the printed character. Therefore, step S12 follows and the printer head 3 is moved back by only the distance stored in the space amount 38 and is located over the printed character. The space amount 38 is reset to "0" in step S17 and the word deleting process is finished. If the memory content of the correction buffer 33 indicated by the pointer 37 is the control code in step S1, step S13 follows. If the control code is not the line end code (DL) in step S13, the control code is the buffer start code (BG). Therefore, this means that no printed character exists, so that the word deleting process is finished. Since such a state relates to the case where the word delete key 44 was input when the character to be deleted does not exist, this state is regarded as an abnormal operation and a warning may be given to the operator by a buzzer or the like.

On the other hand, if the control code indicates the line end code (DL) in step S13, step S14 follows and the platen 6 of the printer mechanism 2 is rotated to locate the printer head to the previous line. In step S15, the pointer 37 is moved back and the line end code (DL) is deleted. Step S16 then follows and the printer head 3 is moved to the absolute position shown by the position code (CP) indicated by the pointer 37. The printer head 3 is located over the printed character. In step S17, the space amount 38 is reset to "0" and the word deleting process is finished.

Second embodiment

In the foregoing apparatus of the embodiment, even if a correction word is input during the execution of the word deletion, the key data input by the keyboard 1 is temporarily stored into the key buffer 34, so that a problem such that the input key data is lost does occur. The key data stored in the key buffer 34 is not read out so long as the word deleting process is finished.

The storage control of the key input will now be described with reference to FIGS. 9A and 9B.

Figure 9A:
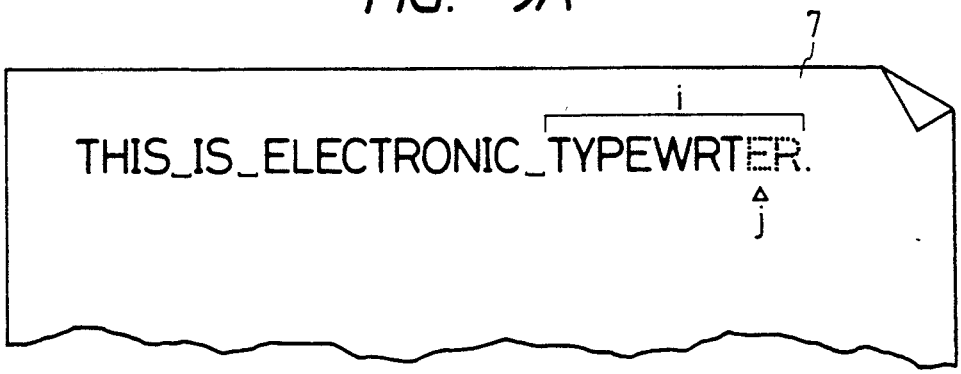
FIGS. 9A and 9B are diagrams for explaining the key input in the word deleting operation.

FIG. 9A is a diagram showing a state during the execution of the word deletion of a word "TYPEWRTER." (shown in a region i in the diagram) as a printed character string having the wrong spelling. The characters (ER.) shown as broken lines in the diagram denote that they have already been deleted. The printer head 3 is located at the position j in the diagram.

Figure 9B:
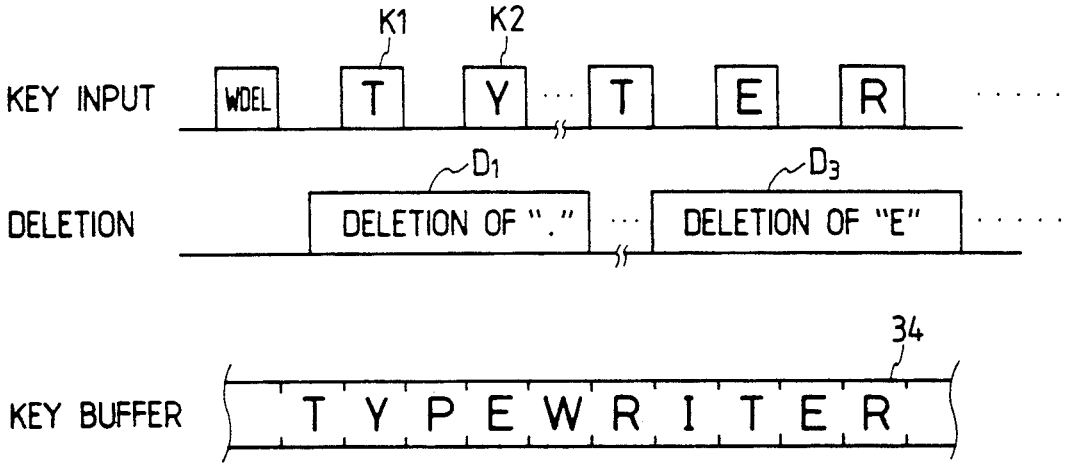

FIG. 9B shows printer mechanism control timings which are required for the word deleting operations such as deletion (D1) of ".", deletion (D2) of "R", deletion (D3) of "E", . . . by inputting the word delete key (WDEL) 44 from the keyboard 1. The operating times differ in dependence on the characters to be deleted or the like. On the other hand, the key input is retrieved at every predetermined period by using counting means in the timer 36 of the apparatus. When the key input is detected, the input key data is immediately stored into the key buffer 34.

Therefore, even during the deleting operation, the correction word such as "T" input (K1), "Y" input (K2), . . . can be also input. Since the input characters or the like are stored in the key buffer 34, when the word deleting operation is finished, the characters stored in the key buffer 34 are sequentially read out in accordance with the storing order and a desired correction word "TYPEWRITER." is printed and output. In this manner, the input waiting time is reduced, the throughput is raised, and the smooth operation is provided.

Figure 10:
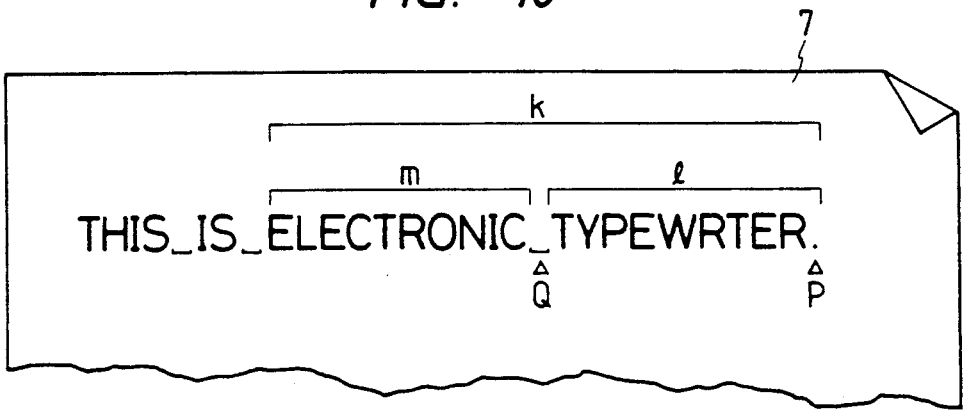
FIG. 10 is a diagram for explaining the problems in the first embodiment.

However, when the word delete key 44 is input to delete a character string l "TYPEWRTER." in a state in which a sentence shown in FIG. 10 has been printed and the printer head 3 is located at P in FIG. 10, a character string k "ELECTRO...WRTER." is deleted because the operator forgot to input the space at the position O in FIG. 10. Consequently, there is a problem such that a correct printed character string m "ELECTRONIC" is also unwillingly deleted. On the other hand, when the operator inputs "TYPEWRITER." after the word delete key 44 was input in order to correct "TYPEWRTER." to "TYPEWRITER." without becoming aware of the absence of the space at point O, the printed result becomes an undesirable sentence such as "THIS_IS_TYPEWRITER.". In order to obtain a desired sentence of the operator, "TYPEWRITER." must be again deleted and "ELECTRONIC_TYPEWRITER." must be input. There is a fear such that the operations become very complicated.

The above construction of the apparatus and the like are similar to the foregoing embodiment. The flag and register buffer area 35 in the RAM 32 has an E-flag 351 (not shown) and an R-flag 352 (not shown). Both of the E-flag 351 and the R-flag 352 are reset upon initialization of the power-on of the apparatus or the like.

FIG. 11 shows a flowchart for the word deletion processing program stored in the ROM 31 of the control logic circuit 11. This program is started when a word deletion instruction is input by the word delete key 44.

The contents of the processes in steps S1 to S17 in the flowchart of FIG. 11 are the same as those shown in FIG. 8 described in the foregoing embodiment.

If the pointer 37 indicates the character code in step S1, step S2 follows. If the printer head 3 exists over the printed character (space amount 38="0") in step S2, step S20 follows. In step S20, the E-flag 351 is set to "1" to make the operation to stop the word deleting operation valid by a key input process, which will be explained hereinlater. The following word deleting operation is started. In step S3, a desired printed character is deleted and step S4 follows and the pointer 37 is moved back and the deleted character data is deleted from the correction buffer 33. In step S5, the distance until the character to be deleted next is stored into the space amount 38. Then, step S6 follows. If the pointer 37 indicates the character code in step S6, a check is made in step S21 to see if the stop operation has been instructed or not by checking the R-flag 352. If NO, step S7 follows and the printer head 3 is moved to the position over the character to be deleted. The space amount 38 is reset in step S8. The processes in steps S3 to S8 are repeated until the control code (delimiter of a word) is detected in step S6.

On the other hand, if the R-flag 352 has been set in step S21, this means that the stop of the operation has been requested. Therefore, step S22 follows and the E-flag 351 and R-flag 352 are reset and the input of the stop operation is inhibited and the word deleting process is stopped. Since the stop discriminating step S21 is executed every deletion of the character, the operation can be stopped at an arbitrary position during the word deleting operation.

When an operation stop is not requested, the control code (delimiter of a word) is detected in step S6. The processing routine advances to step S9. If the pointer does not indicate the space code (SP) in step S9, the E-flag 351 and R-flag 352 are reset in step S22 and the word deleting process is finished. If the pointer indicates the space code (SP) in step S9, the space amount 38 is updated in step S10. Step S11 then follows and the pointer 37 is moved back and the space code (SP) is deleted. In step S22, the E-flag 351 and R-flag 352 are reset and the word deleting process is finished.

On the other hand, if the space amount 38 is not set to "0" in step S2, the printer head 3 is moved to the nearest printed character in step S12. Step S17 follows and the space amount 38 is reset. The word deleting process is finished.

On the other hand, if the pointer indicates the control code in step S1, step S13 follows. If the control code does not indicate the line end code (D1) in step S13, the word deleting process is finished. If the line end code (D1) has been indicated in step S13, the recording paper 7 is returned to the previous line in step S14. In step S15, the pointer 37 is moved back and the line end code (D1) is deleted. Step S16 then follows and the printer head 3 is moved to the position indicated by the position code (CP). In step S17, the space amount 38 is reset. The word deleting process is finished.

The key input process will now be described.

FIG. 12 is a flowchart for a key input processing program stored in the ROM 31 in the control logic circuit 11. The state of the keyboard 1 is retrieved at every predetermined time by the interrupting process or the like on the basis of an output (INT2) of the counting means of the timer 36. When the key input is detected, the execution of the above program is started.

First, if the word deletion stop operation is invalid in step S30, that is, if the E-flag 351 is not set in step S20 in FIG. 11, step S31 follows. If a blank area exists in the key buffer 34, the input key data is stored into the key buffer 34 in step S32 and the key input process is finished. If the key buffer 34 is filled with data, the key input process is finished. At this time, the overflow of the key buffer can be also warned by a buzzer sound or the like.

On the other hand, if the E-flag 351 has been set in step S30, step S33 follows and a check is made to see if the word deletion stop operation is executed or not. The word deletion stop operation can be also executed by inputting an independent function key. However, in such a case, the number of keys on the keyboard 1 increases and there is a fear such that the cost of the apparatus rises. Therefore, the stop operation is executed by inputting a combination of the existing keys on the keyboard 1, for instance, by inputting the word delete key 44 with the code key 45 depressed.

If the stop operation is executed in step S33, step S34 follows and the R-flag 352 is set such that the stop is determined in the discriminating step S21 in FIG. 11. In the next step S35, the key buffer 34 is reset to delete the key data which was input during the word deleting operation and the key input process is finished. The problem in the foregoing embodiment can be solved by such a process. On the other hand, even if the key buffer 34 is filled with data, the key data of the stop operation is processed without being stored into the key buffer 34. Therefore, in the case of the slow operation such as a deleting operation, even if the key input operations had been executed at a high speed and the key buffer 34 overflowed, the word deleting operation can be stopped.

According to the invention, in the case where one of the keys arranged on the same keyboard in a matrix form was solely input, the key input data is stored into the FIFO buffer. When the key input operations were performed by a combination of special keys, the key input data is not stored into the FIFO buffer but the special instructing function can be provided.

On the contrary, if the stop operation is not indicated in step S33, this means that the key input such as a correction word or the like has been performed during the word deleting operation. Therefore, step S31 follows and if a blank area exists in the key buffer 34, the key input data is stored into the key buffer 34 in step S32 and the key input process is finished. Thus, a correction word or the like can be also input during the word deleting operation.

By the above operation control, the purpose of the embodiment such that the word deleting operation is stopped at an arbitrary position can be accomplished.

The effects shown in the foregoing embodiment are not obviously lost.

In the above two embodiments, the word delete key 44 has been used to instruct the word deletion. However, for instance, the word deletion can be also instructed by inputting the delete key 43 with the code 45 depressed.

On the other hand, if the foregoing special key combination input is applied to, for instance, the operation of the temporary print stop function, the hood-open sensor provided in the conventional recording apparatus such as a typewriter or the like can be omitted. The low-cost apparatus can be provided without reducing the functions of such an apparatus.

Although the embodiment has been described with respect to word deletion, the invention can be also similarly applied to the deletion of one line. In such a case, it is sufficient that the deleting operation is finished by using the line end code (D1) and buffer start code (BG).

As described above, if the word deletion instruction is input when the printer head does not exist over the printed character, the printer head can be easily moved to the position over the nearest printed character to be deleted. On the other hand, even if the printed characters to be deleted exist on a plurality of lines rather than one line, the printer head can be easily moved to the position of a desired printed character to be deleted without operating a plurality of keys as in the conventional apparatus.

Further, there is an advantage such that a correction word or the like can be input even during the word deleting operation, so that the working time to correct a sentence can be reduced.

On the other hand, since the word deleting operation can be stopped at an arbitrary position, the deletion is not performed in vain in the case of the erroneous operation, so that the high efficient typing work can be provided.

Further, although what is called a daisy wheel printer has been used as a printing apparatus in the embodiments, the similar effect can be also obtained by applying the invention to other recording apparatuses such as a thermal copy transfer printer and the like.

What is claimed is:

1. A character processing apparatus comprising:

input means for inputting a plurality of character strings;

deletion instructing means for generating a deletion instruction;

first memory means for storing the plurality of character strings input by said input means;

recording means for recording the plurality of character strings stored in said first memory means onto a recording medium, said recording means being capable of deleting the recorded character strings;

second memory means for storing data indicating the amount of movement of said recording means; and control means, in response to the deletion instruction by said deletion instructing means, when said recording means is positioned at a position corresponding to one of the plurality of character strings recorded on the recording medium, for permitting said recording means to delete the one of the plurality of character strings, and when said recording means is not positioned at a position corresponding to the one of the plurality of character strings recorded on the recording medium, for controlling movement of said recording means so that said recording means is moved to the position of the nearest character string in accordance with the data indicating the amount of movement of said recording means stored in said second memory means and is stopped there.

2. An apparatus according to claim 1, wherein said recording means comprises a type wheel printer mechanism, a printing ribbon to print by impacting a type, and a deleting ribbon to delete the printed character.

3. An apparatus according to claim 1, wherein said input means comprises means for inputting a plurality of English language character strings and each of said character strings corresponds to one word.

4. A character processing apparatus comprising:

input means for inputting a plurality of character data;

first memory means for storing the plurality of character data input by said input means;

recording means for recording a plurality of character strings comprising characters corresponding to the character data stored in said first memory means onto a recording medium;

deleting means for deleting the characters and the character strings recorded on the recording medium;

second memory means for storing data indicating the amount of movement of said deleting means;

deletion instructing means for generating a deletion instruction; and control means, in response to the deletion instruction by said deletion instruction means, when said deleting means is positioned at a position corresponding to a specific character string recorded on the recording medium, for permitting said deleting means to delete the specific character string and when said deleting means is not positioned at the position of the specific character string recorded on the recording medium, for controlling the movement of said deleting means so that said deleting means is moved to the position of the nearest character string in accordance with the data indicating the amount of movement of said deleting means stored in said second memory means and is stopped there.

5. An apparatus according to claim 4, wherein said recording means comprises a type wheel printer mechanism.

6. An apparatus according to claim 4, wherein said input means comprises means for inputting a plurality of character data representing English language characters and wherein said deletion instructing means instructs the deletion on a word unit basis.

7. A character processing apparatus comprising:

input means for inputting character data and control data;

first memory means for storing the character data and control data input by said input means;

printing means for printing characters corresponding to the character data stored in said first memory means onto a recording medium, said printing means being capable of deleting the printed characters;

second memory means for storing data indicating the amount of movement of said printing means;

pointer means for indicating the position on the recording medium where said printing means is located, wherein said second memory means also stores data corresponding to the position of said printing means indicated by said pointer means;

detecting means for detecting whether the data in said second memory means corresponding to the position indicated by said pointer means is character data or the control data;

deletion instructing means for generating a deletion instruction; and control means, in response to the deletion instruction by said deletion instructing means, when the result of the detection by said detecting means indicates that the data in said second memory means corresponding to the position indicated by said pointer means is character data, for permitting said printing means to delete a character, and when the result of the detection by said detecting means indicates that the data in said second memory means corresponding to the position indicated by said pointer means is control data, for controlling the movement of said printing means so that said printing means is moved to the position of the nearest printed character in accordance with the data indicating the amount of movement of said printing means stored in said second memory means and is stopped there.

8. An apparatus according to claim 7, wherein said printing means comprises a type wheel printer mechanism, a printing ribbon to print by impacting a type, and a deleting ribbon to delete the printed character.

9. An apparatus according to claim 7, wherein said character data which is input by said input means represents English character code.

10. An apparatus according to claim 7, wherein said input means comprises means for inputting control data comprising a space code.

11. A character processing apparatus comprising:

input means for inputting character data and control data;

first memory means for storing the character data and control data input by said input means;

printing means for printing characters corresponding to the character data stored in said first memory means onto a recording medium, said printing means being capable of deleting the printed characters;

second memory means for storing data indicating the amount of movement of said printing means;

pointer means for indicating the position on the recording medium where said printing means is located, wherein said second memory means also stores data corresponding to the position of said printing means indicated by said pointer means;

detecting means for detecting whether the data in said second memory means corresponding to the position indicated by said pointer means is character data or the control data;

deletion instructing means for generating a deletion instruction; and control means, in response to the deletion instruction by said deletion instructing means, when the result of the detection by said detecting means indicates that the data in said second memory means corresponding to the position indicated by said pointer means is character data, for permitting said printing means to delete the character corresponding to the deleted character data, and when the result of the detection by said detecting means indicates that the data in said second memory means corresponding to the position indicated by said pointer means is control data, for controlling the movement of said printing means so that said printing means is moved to a position at a previous line from a present line at which said printing means is positioned.

* * * * *

UNITED STATES PATENT AND TRADEMARK OFFICE

CERTIFICATE OF CORRECTION

PATENT NO. 5,248,206

DATED September 28, 1993

INVENTOR(S) KAWANABE

It is certified that error appears in the above-indentified patent and that said Letters Patent is hereby corrected as shown below:

Column 1

Figure 13A:
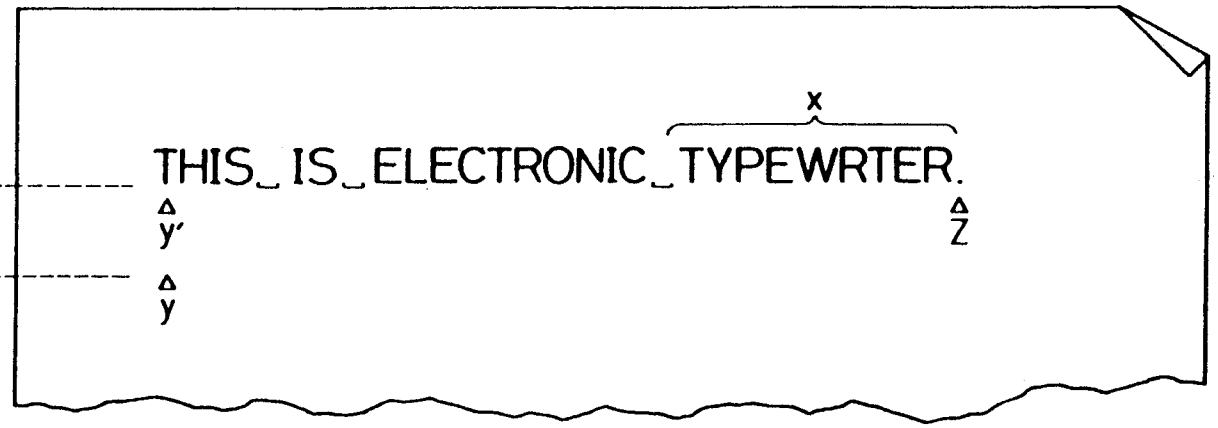
FIG. 13A PRIOR ART
FIGS. 13A, 13B, 14A, 14B, and 14C are diagrams for explaining conventional examples.
Figure 13B:
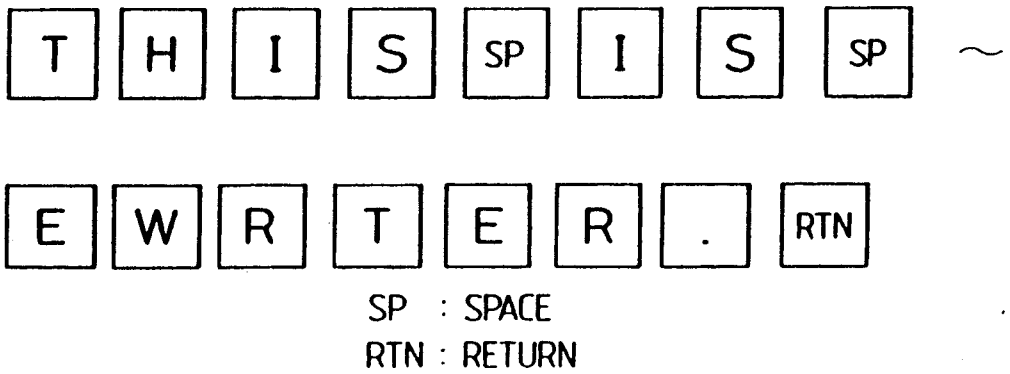
FIG. 13B PRIOR ART
Figure 14A:
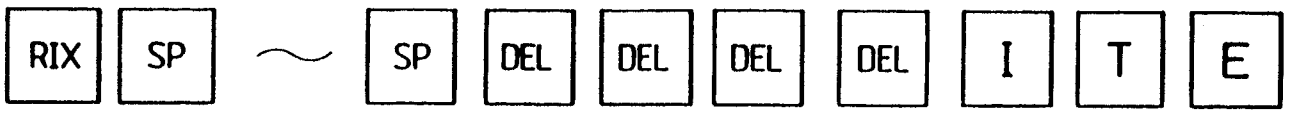
FIG. 14A PRIOR ART
Figure 14B:
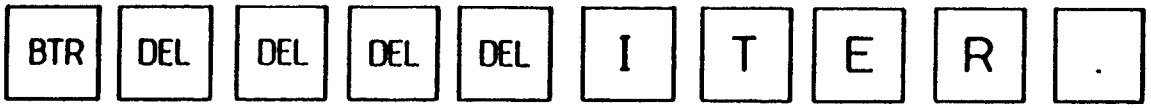
FIG. 14B PRIOR ART
Figure 14C:
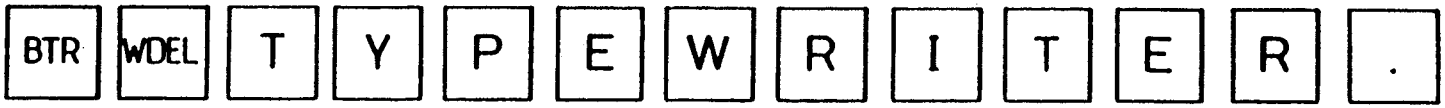
FIG. 14C PRIOR ART

Line 54, change "key printer" to --key input (SP) a predetermined number of times, the printer--.
Line 55, change "FIG. 13" to --FIG. 13.--.

Column 3

Line 40, change "shown)" (first occurrence) to --shown).--.
Line 55, delete "is" (first occurrence).

Column 4

Line 20, change "area" to --an area--.
Line 21, change "area" to --an area--.
Line 23, change "area" to --an area--.

Column 5

Line 2, change "shift" to --to shift--.

Column 6

Line 28, change "FIG. 58," to --FIG. 5B,--.

Column 13

Line 15, change "instruction" to --instructing--.

UNITED STATES PATENT AND TRADEMARK OFFICE

CERTIFICATE OF CORRECTION

PATENT NO. 5,248,206 Page 2 of 2

DATED September 28, 1993

INVENTOR(S) KAWANABE

It is certified that error appears in the above-indentified patent and that said Letters Patent is hereby corrected as shown below:

Column 14

Line 20, change "character code." to --language characters.--

Line 44, delete "the".

Signed and Sealed this

Seventeenth Day of May, 1994

Bruce Lehman

*Attest:*

BRUCE LEHMAN

*Attesting Officer*

*Commissioner of Patents and Trademarks*